United States Patent [19]

Reid et al.

[11] Patent Number: 4,896,070

[45] Date of Patent: Jan. 23, 1990

[54] VCR CABINET

[76] Inventors: Dwight K. Reid, P.O. Box 16680, Houston, Tex. 77222; Glen T. Balusek, 3330 Lake Ridge Bend, Spring, Tex. 77380

[21] Appl. No.: 211,432

[22] Filed: Jun. 24, 1988

Related U.S. Application Data

[63] Continuation-in-part of Ser. No. 54,225, May 26, 1987, abandoned.

[51] Int. Cl.[4] ..... A47B 81/00

[52] U.S. Cl. ..... 312/290; 220/334; 220/345; 312/223; 312/7.1

[58] Field of Search ..... 312/290, 7, 1, 350, 312/324, 325, 213; 206/305, 320; 211/4, 184; 248/500, 501, 551, 552, 553; 220/210, 334, 345

[56] References Cited

U.S. PATENT DOCUMENTS

| | | | |
|---|---|---|---|
| 750,673 | 1/1904 | Mason | 312/290 |
| 1,654,804 | 1/1925 | Haag | 312/7.1 |
| 2,172,605 | 9/1939 | Bourn | 312/290 X |
| 2,542,836 | 2/1951 | Porter et al. | 248/507 X |
| 2,823,971 | 2/1958 | Hoyt | 312/290 |
| 3,116,096 | 12/1963 | Kavanagh | 312/290 X |
| 3,198,468 | 8/1965 | Vye | 248/500 |
| 3,926,487 | 12/1975 | Reyes | 312/213 X |
| 4,046,439 | 9/1977 | Lee | 312/290 X |
| 4,347,537 | 8/1982 | Schoettle et al. | 206/381 X |
| 4,406,387 | 9/1983 | Rasor | 220/334 X |
| 4,458,813 | 7/1984 | Tushinsky et al. | 206/305 X |
| 4,548,330 | 10/1985 | Hewitt et al. | 220/210 |
| 4,603,787 | 8/1986 | Essary | 220/345 X |
| 4,629,089 | 12/1986 | Frederico et al. | 220/334 |
| 4,658,956 | 4/1987 | Takeda et al. | 206/305 X |
| 4,669,001 | 5/1987 | Thrush | 206/320 X |
| 4,757,913 | 7/1988 | Yerman | 220/345 |
| 4,775,075 | 10/1988 | Kamin et al. | 220/345 X |

*Primary Examiner*—Joseph Falk

*Attorney, Agent, or Firm*—Kenneth H. Johnson

[57] ABSTRACT

An apparatus designed to house and secure a video cassette recorder wherein said apparatus can be accessed completely through only one major entrance which can be protected by operable doors, which can be secured by locking mechanisms and thereby prohibit any undesirable entry. The apparatus is used to house and secure any VCR such that once a video cassette recorder is placed inside said apparatus, the doors closed and locked, access to the video recorder becomes prohibited. The apparatus allows for normal usage of a VCR while at the same time prevents unwanted tampering to the video recorder.

6 Claims, 4 Drawing Sheets

VCR CABINET

This application is a continuation in part of Ser. No. 054,225 filed May 26, 1987 now abandoned.

BACKGROUND OF THE INVENTION

Modern advances in electronics have made home entertainment systems more plentiful and economical for the average American family. Recent statistics indicate that two out of every five American homes have a VCR. Video Cassette recorders vary greatly in size and price. Consequently, a video cassette recorder could range in cost from as low as $200 to as high as $2000.

Various support products have been developed to aid in the upkeep of video cassette recorders. Such products are for example VHS and BETA head cleaners and various dust covers. Head cleaners are designed to keep VCR heads clean which will eliminate tape sticking whereas dust covers keep dust from accumulating on the VCR. Other support products such as portable VCR and TV cabinets are used to house VCR units and some may even have openings that will allow the necessary connections from the VCR to a TV to allow personal viewing. A recent patent, Federico et al U.S. Pat. No. 4,629,089 is a basic attempt at protection, however the device disclosed is primarily an open box with a hinged front.

One major deficiency of most of these support systems is their inability to prevent unauthorized access and child tampering which could lead to possible damage to video cassette recorders while the recorders are standing or in use. For example, such tampering could include putting foreign objects in the tape deck loading mechanism, handling video tapes with food contaminated hands, and consistent playing and meddling with the controls. The cost of repair associated with such tampering accounts for a large share of the video service market. In fact severe damage to internal electronic parts due to tampering could result in the total loss of a video cassette recorder.

The present invention was developed to eliminate such tampering by allowing only individuals who have the key, entry to the video cassette recorder.

An object of the invention is the provision of means in said video containment apparatus wherein the entrance hereafter referred to as the "major entrance" can be regulated by the use of two operable doors such that in one embodiment one of the doors hereafter referred to as the "operable top door" is attached to the top of the video containment apparatus and opens upward from its locked position whereas the other door hereafter to as the "operable front door" is attached to the front of the operable top door and also opens upwards from its locked position such that if desired the doors can be opened and a video cassette recorder can be completely placed inside the video containment apparatus. A further object of the invention concerning said video containment apparatus is that, if desired, in an alternative embodiment the operable front door could be attached to the front of the video containment apparatus and would open downward from its locked position. The term "operable door" is defined in this text as any door capable of being opened or closed.

A still further object of the invention is the provision in the video containment apparatus wherein the major entrance can be regulated by said operable doors wherein when said operable doors are closed they can be secured by two locking mechanisms. The first locking mechanism is located near the bottom of the operable front door while one part of the second locking mechanism is located under the bottom of the operable top door and the other part of the second locking mechanism is located near the top inside of the video containment apparatus.

Another object of the invention concerning said video containment apparatus is that if desired, the first locking mechanism can be located near the top of the operable front door whenever the operable front door is attached to the front of the video containment apparatus and opens downward from its locked position.

A still further object of the invention is the provision in said video containment apparatus as that when a video cassette recorder is placed inside said apparatus through the major entrance, which can be regulated by operable top and front doors such that said operable doors can be closed and then secured by locking mechanisms located on said operable doors and the video containment apparatus, complete access to the video cassette recorder is prohibited.

Another object of the invention is the provision of means in said video containment apparatus such that when any smaller size video cassette recorder is placed inside said apparatus the video component recorder can be firmly secured by the use of an adjustable panel located within the video containment wherein said panel contains stopper supported tip screws which can be adjusted in or out of the panel such that when a video cassette recorder is housed inside the video containment apparatus the stopper supported tip screws can be adjusted down on the top of the video cassette recorder holding it firmly and secure. The pads on the tip of the screws may be made out of materials such as various rubbers, natural and synthetic, plastics, wood, metals, or styrofoam.

A further object of the invention is the provision in said video containment apparatus such that when a video cassette recorder is placed inside the video containment apparatus wherein said apparatus doors are closed and locked securing the major entrance, said video containment apparatus provides a means of a "minor entrance" wherein said minor entrance is located at the rear of the video containment apparatus such that said minor entrance allows access only to the rear of the video cassette apparatus for the necessary cable connections from the VCR to a TV or monitor system.

A still further object of the invention is the provision in said video containment apparatus of air ventilation holes located on the top rear of said video containment apparatus whereas said ventilation holes allows air to circulate normally through the video containment apparatus whereas such air circulation keeps the video cassette recorder cool.

SUMMARY OF THE INVENTION

The present invention is an apparatus for the housing and securing of a video cassette recorder such that the video cassette recorder is protected from undesirable and unsupervised tampering which could result in damage to sensitive component parts. To achieve this purpose the invention preferably can be designed as, but not limited to a substantially rectangular or square box hereafter referred to as a "video containment apparatus" which is large enough to house conventionally sized video cassette recorders. Said video containment apparatus has one entrance which will allow complete access to a video cassette recorder for its removal or placement. The video containment apparatus can be made out of any viable materials such as glass, metals, wood, synthetic fibers, or plastics. The preferred materials would be wood or plastics.

The present invention employs the use of a box which could be square or rectangular and which has one entrance that will allow complete access to its interior such that said entrance can be regulated by a set of doors. The doors can be secured by a locking mechanism such that, if desired, a video cassette recorder can be placed completely inside said box, herein referred to as a "video containment apparatus" or cabinet wherein said video containment apparatus can then be locked thereby securing and preventing tampering with the video recorder. The invention also employs the use of an adjustable panel located within the video containment apparatus whereby said adjustable panel allows the video containment apparatus to secure firmly therein different sizes of video recorder. The video containment apparatus is small and compact enough such that it can be transported from one place to another, if desired.

In a further embodiment the operable doors are arranged such that the top operable door is slidably engaged in the top of the apparatus and the front operable door is hinged for opening to the side.

The video containment apparatus may be used with commercial dust covers to help minimize the accumulation of dust on the video cassette recorder when said recorder is housed within the video containment apparatus.

BRIEF DESCRIPTION OF THE DRAWINGS

Other objects and advantages of the invention will become more apparent from the specification taken in conjunction accompanying drawings in which.

DETAILED DESCRIPTION OF THE INVENTION

Figure 1:
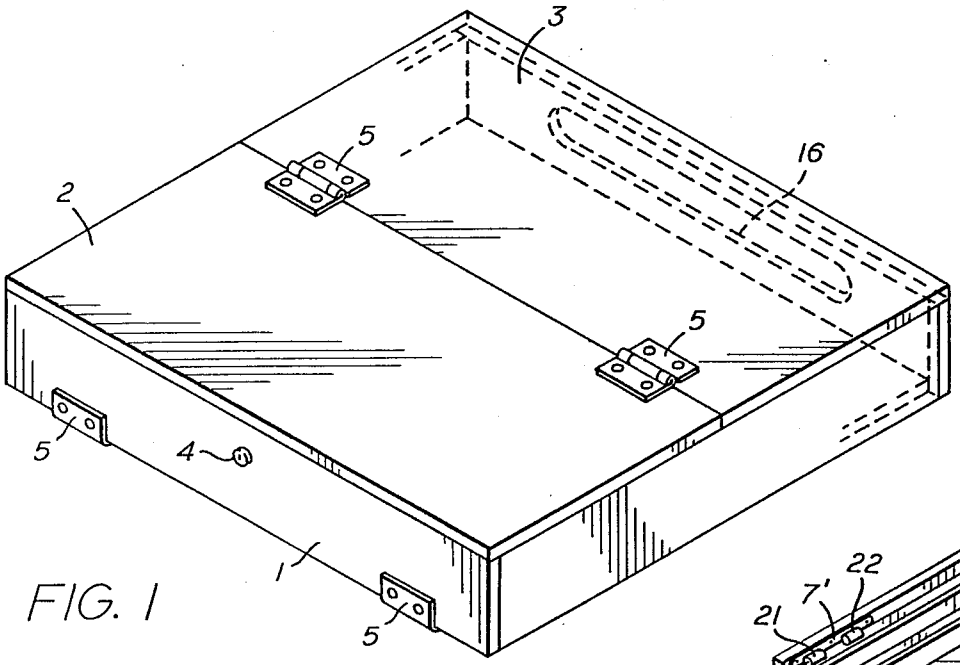
FIG. 1 is an isometric view of one embodiment of the present video containment apparatus.

Referring to the drawing shown in FIG. 1, numeral 1 designates an operable front door that opens upward from the video containment apparatus or if desired an operable front door that opens downward from the video containment apparatus (FIG. 2), whereas operable top door 2 also opens upward from the video containment apparatus; FIG. 1 also illustrates the top housing 3 of the video containment apparatus, a locking mechanism 4, located on operable front door 1 and hinges 5, that attaches both operable front door 1 to the top of operable top door 2 or if desired hinges 5 could attach operable front door 1 to the video containment apparatus and operable top door 2 to the top housing 3 of the video containment apparatus.

Figure 2:
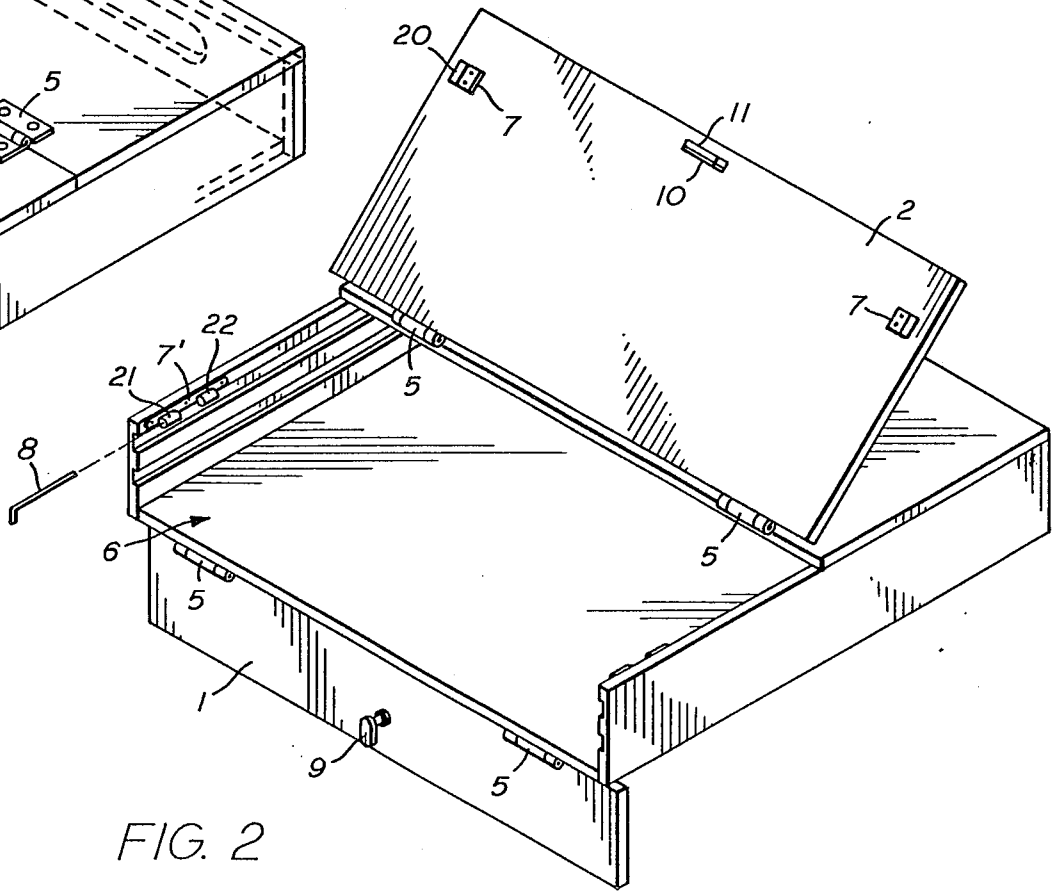
FIG. 2 is a view of said video containment apparatus of FIG. 1 illustrating the major entrance of said operable doors, and the two locking mechanisms one located on the front door and the other located on both the top door of the video containment apparatus.

In FIG. 2 when operable front door 1 is open downward away from the video containment apparatus and when operable top door 2 is also opened upward, away from the video containment apparatus a means of access is provided to the major entrance 6 whereby a video cassette recorder can be placed inside the video containment apparatus by way of major entrance 6; furthermore, after the video cassette recorder is placed within the video containment apparatus operable top door 2 is brought down towards the video containment apparatus until the first piece of locking mechanism 7 (a hollow tube or cylinder 20) located underneath operable top door 2 rest securely in the space of the second piece of locking mechanism 7' (two hollow tubes or cylinders 21 and 22) separated by said space located at the top inside edge of the video containment apparatus such that when support pin 8 is placed completely through the hollow openings of locking mechanism 7/7', operable top door 2 can not be raised.

Figure 7:
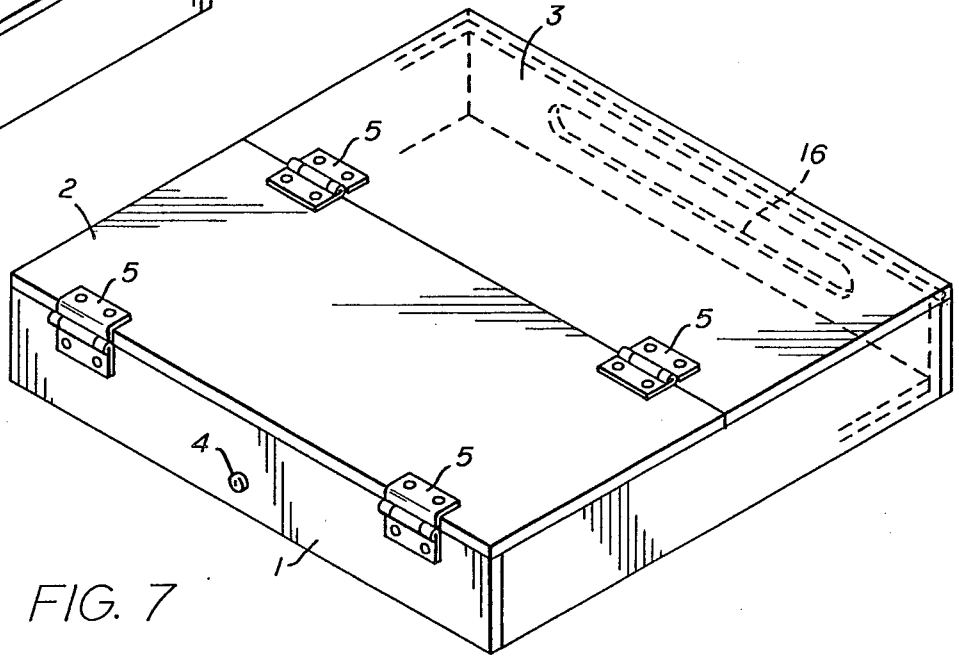
FIG. 7 is an isometric view of an embodiment of the apparatus having the front door hinged to the top door.

Thereafter, operable from door 1 is brought towards the video containment apparatus until said door fits firmly down against the video containment apparatus (FIG. 7 embodiment). Or if operable front door 1 is attached to the front of the video containment apparatus (FIG. 1) said door is brought upwards from its open position until the operable front door 1 rest firmly up against said apparatus and top door 2. Locking mechanism 4 which is a key lock is engaged such that the arm 9 of locking mechanism 4 fits securely in slot 10 which can be located on the bottom floor inside the video containment apparatus (not shown) or located underneath operable top door 2 if operable front door 1 is attached to the front of the video containment apparatus (FIG. 2). In FIG. 2 safety stop 11 prevents any possible movement forward of arm 9 if operable front door 1 is pulled forcibly. When the above operations are performed as described access to a video recorder cassette placed inside the video containment apparatus becomes prohibited by way of major entrance 6.

Figure 14:
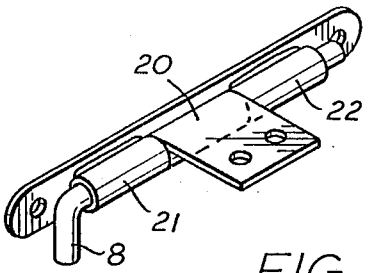
FIG. 14 is a detail of the latching means for the top door.

The top door 2 is held in place by means of pin 8 which engages the tubes 21 and 22 located on the inside of the video containment apparatus (detail FIG. 14) and which align with tube 20 when the top door 2 is in the closed configuration (FIG. 1). Preferably two such latching means are located, one on each side of top door and the corresponding inside of the apparatus.

When the front door 1 is closed the pin 8 is not accessible, hence by locking the front door with lock 4, i.e., the arm 9 is rotated by the key (not shown) and locked in place in slot 10 in stop 11 the cabinet is entirely closed. The lock 4 is a conventional blade type lock. Any type of lock which will secure front door 1 to the top door may be used.

Figure 3:
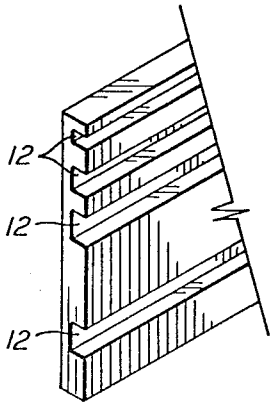
FIG. 3 is an enlarge sectional view which illustrates slots located on the interior walls of the video containment apparatus shown in FIG. 2 which allows for the use of the adjustable panel.
Figure 5:
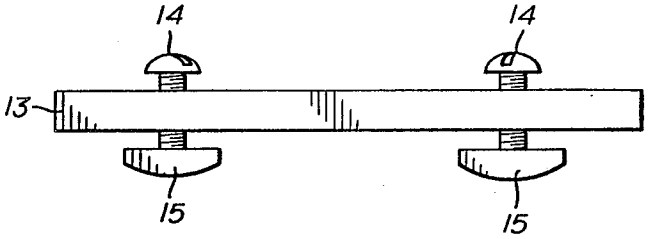
FIG. 5 is a side view of the adjustable panel of FIG. 4 illustrating the stopper supported tip screws.
Figure 4:
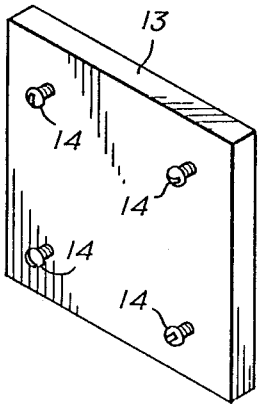
FIG. 4 is an isometric view of the adjustable panel whereas said adjustable panel contains stopper supported tip screws.
Figure 8:
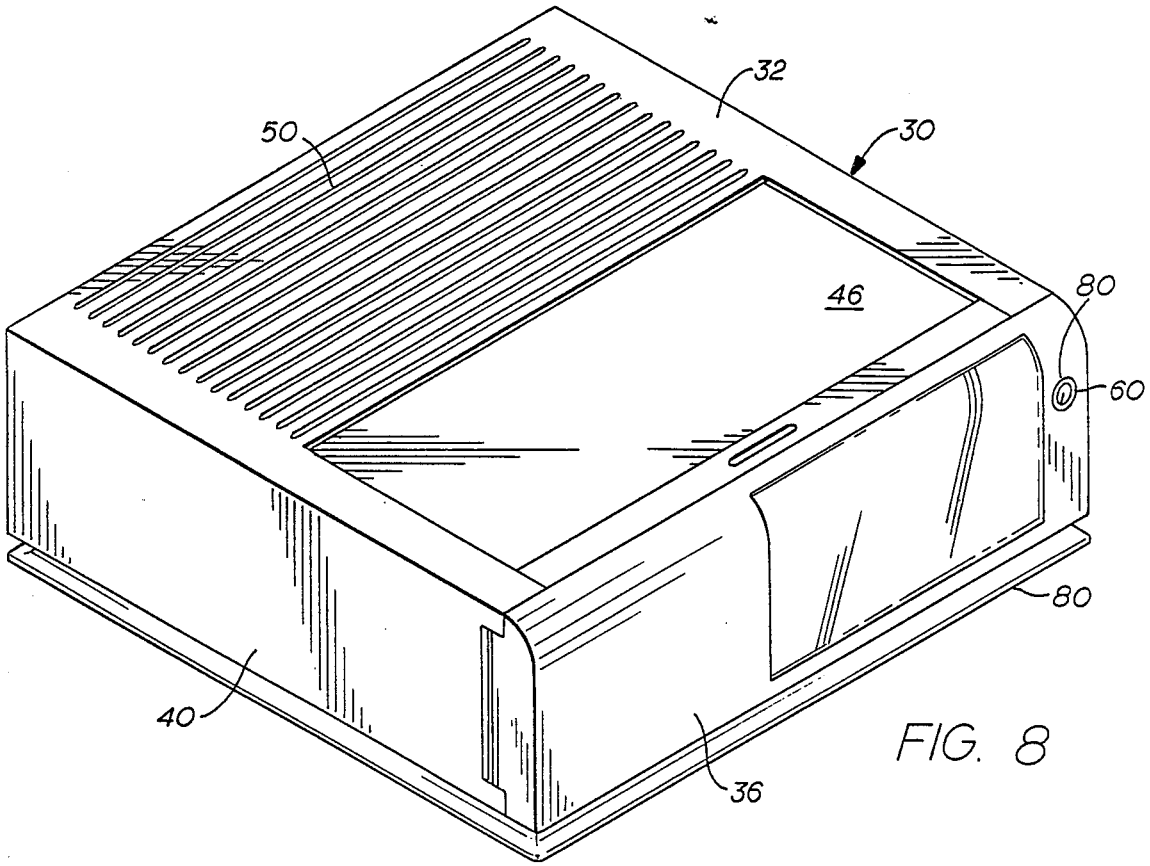
FIG. 8 is an isometric view of an embodiment having a slidable top door and side hinged front door.
Figure 9:
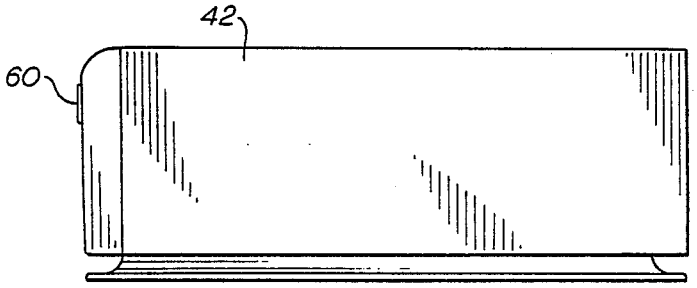
FIG. 9 is a side elevational view of the embodiment of FIG. 8.
Figure 10:
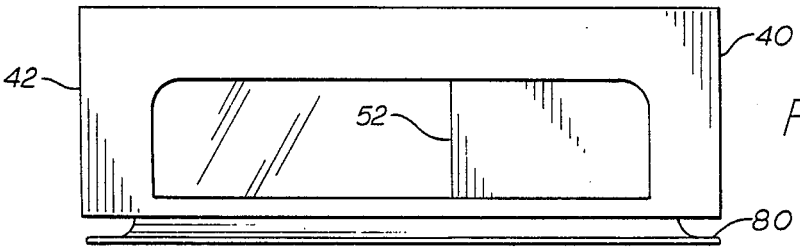
FIG. 10 is a rear elevational view of the embodiment of FIG. 8.
Figure 12:
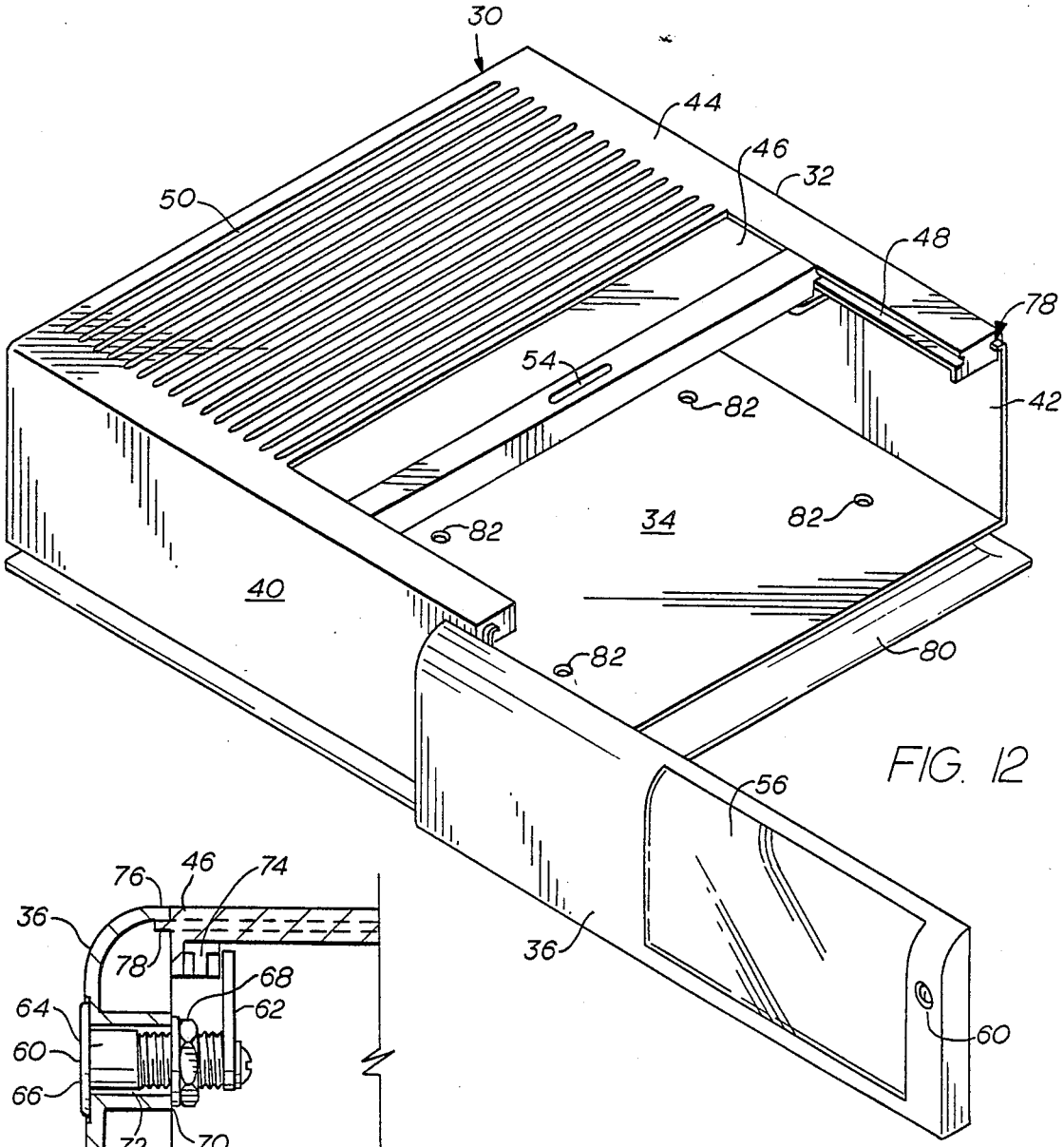
FIG. 12 is an isometric view of the embodiment of FIG. 8 with both doors open.

FIG. 3 illustrates in detail slots 12 which are located on the inside walls of the video containment apparatus parallel from each other. FIG. 4 is a top view of adjustable panel 13 with adjustable screws 14 wherein depending upon the size of a video cassette recorder the adjustable panel 13 can be placed in the appropriate slots 12 where needed. FIG. 5 is a side view of adjustable panel 13 with adjustable screws 14 attached to stopper supports 15. When adjustable screws 14 are adjusted downward the stopper supports 15 rest firmly against the video cassette recorder thereby holding the video cassette recorder firmly when placed inside the video containment apparatus.

Figure 6:
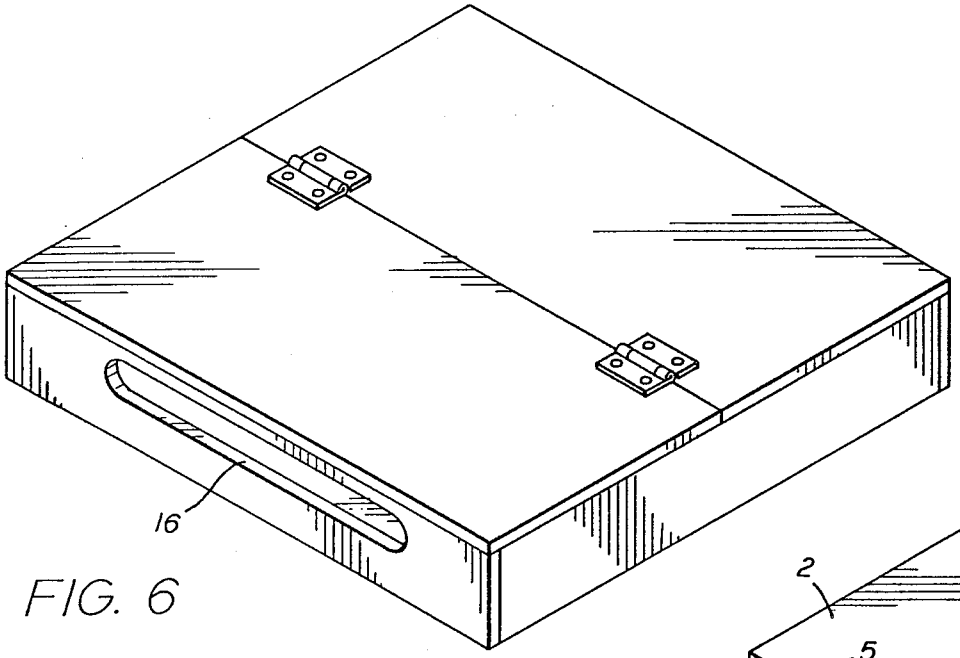
FIG. 6 is a partial isometric view of the video containment apparatus illustrating the minor entrance located at the rear of said apparatus.

FIG. 6 illustrates minor entrance 16 located at the rear of the video containment apparatus such that when operable doors 1 and 2 are closed and secured by locking mechanisms 7 and 4, only access to the rear of the video cassette record is allowed. Minor entrance 16 allows for the necessary connections from the video cassette recorder to a TV or monitoring system. Ventilation holes 17 provide air circulation through the video containment apparatus to help prevent overheating of the video cassette recorder while inside the video containment apparatus.

FIGS. 8–13 represent a preferred embodiment of the present invention. The cabinet 30 substantially defines a rectangular prism, that is, the top 32 and bottom 34 are substantially parallel, the front door 36 and back side 38 are substantially parallel and sides 40 and 42 are substantially parallel.

Interestingly the top 32 is comprised of two interacting components. Component 44 is fixedly attached to sides 40 and 42 and back 38. Slidable component 46 is mounted into grooves 48 located in top 32 extending the same distance rearward from front door 36 along both sides of component 44. Hence slidable component 46 is the top door previously described in regard to the other embodiments.

The groove 48 extend along under component 44 which is not shown, but easily comprehended.

The slots 50 on component 44 can be mere design or more preferably extend through the top thereby providing vents for the dissipation of heat from the recorder (not shown). The air can circulate through minor opening 52 located in back 38 which is where the wires and cables come into the cabinet 30. The slidable component 46 has a finger grip 54 located on its front edge and is easily slid open and closed by hand. This allows the top loaders to be used and makes placing and removing the recorder easier.

The front door 36 is hinged to side 40 and swings open to the side to allow access to a front loaded tape deck and for placing and removing the recorder. Preferably at least a portion 56 of the front door is clear, i.e., plastic or glass to allow the function display to be seen and for remote control operation. When front door 36 and slidable component 46 are in the closed positions (FIG. 8), a single blade 62 (or arm) lock 60 will hold the two doors together, thereby preventing unauthorized access to the recorder.

The lock is conventional, having a barrel 64, tumblers (not shown), a face plate 66 and a retaining nut 68 and washer 70 holding the lock in channel 72 such that turning the blade 62 (preferably with a key, not shown) will bring the blade behind arm 74 which is situated on the lower front side of slidable component 46. The arm 74 thereby cooperates with blade 62 when the component is seated fully forward in grooves 48 adjacent to (or abutting) the upper end 76 of the front door.

Figure 11:
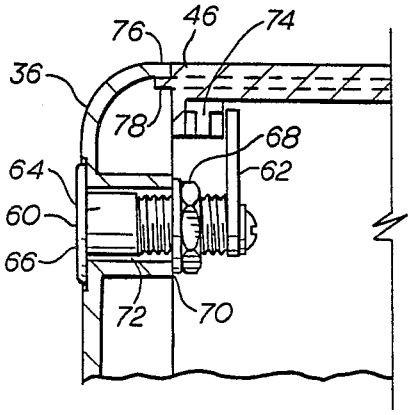
FIG. 11 is a detail of the locking mechanism of the embodiment of FIG. 8.
Figure 13:
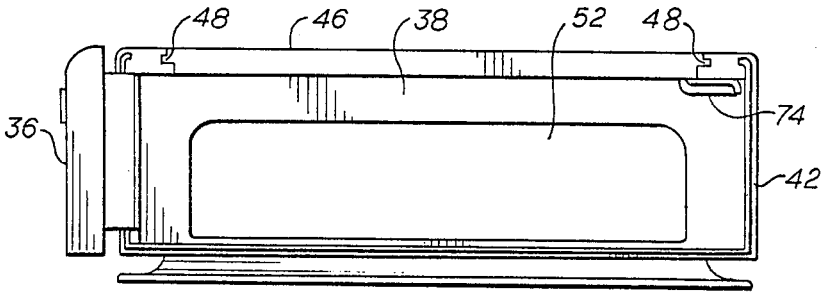
FIG. 13 is a front elevational view of the embodiment of FIG. 12.

A lip 78 on forward edge of each side 40 and 32 abuts and seats against the adjacent portions of the front door 36. When the blade 62 is positioned and engaged as shown in FIG. 11, the components 46 can not slide open and front door can not pivot on its hinge and the cabinet is closed with the contents safe from access.

In the design a base 80, which has been added to raise the door off the base, is not essential to the operation of the cabinet.

One other aspect of the present cabinet are the holes 82 which extend through the bottom 34 (and any base structure to allow bolts, screws or other securing means to attach the cabinet to a surface. This inhibits theft, accidental tip over or other unauthorized movement.

The invention claimed is:

1. A video containment apparatus comprising a rectangular prism having:

a top, two sides, a top door slidably mounted in the top by means of a pair of tracks extending from the front and under a fixed portion of said top, a front comprising a moveable front door contiguous to said top door and hingedly mounted to one of said sides and a bottom and additionally comprising a key activated lock mounted in said front door, said lock having an arm for engaging a portion of said top door whereby both doors are held in place when both are fully closed and said lock activated.

2. The apparatus according to claim 1 having at least one opening located in the bottom for securing the apparatus to a surface.

3. A video recorder cabinet comprising a substantially rectangular prism having a top, bottom, front, rear and two sides, (a) said front being hingedly attached to a side, (b) said top comprising:

(i) a rear portion attached to each side and said rear, a pair of tracks extending from said front adjacent to and parallel to each side and under said rear portion, (ii) an open portion extending between said tracks and rear portion, said rear portion comprising about half of said top and (iii) a slidable portion mounted on to said tracks and extending under said rear portion for providing a closure for said open portion, (c) a key activated lock mechanism mounted in said front door for engaging said front door to said slidable top portion when said slidable portion and front door are abutting; and (d) said rear has a limited access therethrough.

4. The video recorder cabinet of claim 3 wherein the rectangular prism is mounted on a base.

5. The video recorder cabinet according to claim 4 wherein said front is partially transparent.

6. The video recorder cabinet according to claim 5 having mounting holes inside bottom.

* * * * *